US005333543A

United States Patent [19]

Reifenrath et al.

[11] Patent Number: 5,333,543

[45] Date of Patent: Aug. 2, 1994

[54] RAM LOCKING DEVICE FOR A CHIPLESS PRESS WITH STATICALLY CUSHIONED AND PRESSURE-RELIEVABLE TENSION ROD

[75] Inventors: Werner Reifenrath, Betzdorf; Eduard Braun, Wissen, both of Fed. Rep. of Germany

[73] Assignee: Optima Spanntechnik GmbH, Scheuerfeld, Fed. Rep. of Germany

[21] Appl. No.: 975,195

[22] Filed: Nov. 12, 1992

[30] Foreign Application Priority Data

Nov. 30, 1991 [DE] Fed. Rep. of Germany ..... 4139537
Jul. 10, 1992 [DE] Fed. Rep. of Germany ..... 4222714

[51] Int. Cl.[5] ..... B30B 15/00

[52] U.S. Cl. ..... 100/53; 83/DIG. 1; 192/129 R

[58] Field of Search ..... 100/53, 214; 83/DIG. 1; 192/129 R; 248/327, 669

[56] References Cited

U.S. PATENT DOCUMENTS 2,198,767 4/1940 Glasner ..... 100/53 X
2,240,630 5/1941 Stacy ..... 100/53 X
3,095,804 7/1963 Lindner ..... 100/53
4,066,013 1/1978 Skoglund et al. ..... 100/53
4,822,266 4/1989 Amano et al. ..... 100/53 X

FOREIGN PATENT DOCUMENTS 1195169 6/1965 Fed. Rep. of Germany ..... 100/53
2451770 5/1976 Fed. Rep. of Germany ..... 100/53
3342948 8/1984 Fed. Rep. of Germany ..... 100/53
3316364 11/1984 Fed. Rep. of Germany ..... 100/53
1428597 10/1988 U.S.S.R. ..... 100/53

*Primary Examiner*—Stephen F. Gerrity
*Attorney, Agent, or Firm*—Anderson Kill Olick & Oshinsky

[57] ABSTRACT

In a ram locking device for securing the ram of a chipless forming machine, more particularly a heavy press, wherein the tool-carrying ram, movable up and down in the press frame relative to the bed of the press, is supported by the head of an axially adjustable tension rod, the unlocking, more particularly the release of the tension rod, is improved if the tension rod is statically cushioned and is automatically pressure-relieved as the release begins.

10 Claims, 5 Drawing Sheets

RAM LOCKING DEVICE FOR A CHIPLESS PRESS WITH STATICALLY CUSHIONED AND PRESSURE-RELIEVABLE TENSION ROD

FIELD OF THE INVENTION

The invention relates to a locking device for securing the ram of a chipless forming machine, more particularly a heavy press, wherein the tool-carrying ram, which is movable up and down in the press frame relative to the bed of the press, is supported by the head of an axially adjustable tension rod.

BACKGROUND OF THE INVENTION AND PRIOR ART

To make a press accessible for fitting and maintenance work and for repairs to the ram and ram drive, etc., it is necessary to bring the ram into a convenient working position and to secure it there. This can be done by means of ram locking devices according to German Offenlegungsschrift 3 316 364. The known ram locking device comprises a guide rod, mounted concentrically and rotatably in a housing, for a slidably movable spindle that is adjustable relative to the guide rod. The lower end of the spindle projects from the housing on the ram side and is secured to a tension rod carrying a locking member or a tension rod head that faces a corresponding receiving opening on the ram. A rotary movement given to the guide rod is transmitted to the spindle carrying the tension rod and leads to angular displacement of the spindle relative to the housing.

Since the ram of a large press can weigh up to 300 t, several such ram locking devices, preferably four in the case of heavy rams, are always fitted on the crown of the press frame. As soon as the spindle of a ram locking device is adjusted downwards, e.g. by means of an adjusting nut fitted around the externally threaded spindle, the head of the tension rod enters the receiving opening or recess of the ram. After the locking members of all the ram locking devices have been moved into engagement in the corresponding receiving openings of the ram, the locking members, which are shaped as hammer heads, are swivelled through 90° into the retaining position by rotating the spindle. In the retaining position the ram locking device then moves upwards until the tension rod or its head meets the locking bracket of the ram. Since the operating force of each of the locking devices is the same, the load of the ram is distributed equally over all the retaining points.

This and other known ram locking devices suffer from the disadvantage that the great weight of the press ram resting or supported on the tension rod heads and the resulting high frictional forces make it extremely difficult to release the locking device. Hence locking systems that use threaded spindles, inclined planes, detent pawls or the like can no longer be automatically released under the weight of the ram. Before releasing the locking device the tension rods supporting the full weight of the ram must therefore first be relieved of their load. In the known locking devices this is done by raising the ram, for example by means of the main drive or via the ram adjusting means; in each case considerable additional effort is required.

It is therefore an object of the invention to facilitate unlocking, and in particular release of the tension rod, of a ram locking device of the above-mentioned kind, without having to raise the ram.

SUMMARY OF THE INVENTION

This object is achieved, according to the invention, if the tension rod is statically cushioned and can be controllably relieved of pressure. The invention enables pressure relief to be effected internally by pressure relief of the cushion, which is preferably hydraulic, particularly if in doing so the ram is lowered only slightly or not at all. In the case, for example, of a ram locking device having a threaded spindle arranged in an adjusting nut and connected to the tension rod, this unloads the spindle and thus also the adjusting nut, which consequently can be rotated without difficulty, so that as a result of the lower frictional forces easy and reliable release is possible.

Using a cylinder chamber in the head of the tension rod that can be pressure-relieved, a preferred way of realising a static cushion is to form the head of the tension rod as a cylinder that receives a piston of the tension rod. In this way it is very simple to arrange that the tension rod acts as a single-acting hydraulic cylinder. The tension rod head, which serves as a cylinder and is usually hammer-shaped and prevented from rotating relative to the piston, enables a rotation imparted to the guideway in which the slidably movable threaded spindle is adjustable relative to the guideway to be transmitted to the tension rod head by way of the spindle and the piston to be used for angular adjustment of the tension rod head relative to a corresponding opening in the ram of the press. The bearing surface of the tension rod head then overlaps the corresponding bearing surface of the ram in the bracket, that is to say the tension rod head lies transverse to the opening in the ram, so that the tension rod head comes to bear on the bearing surface of the ram.

It is preferable to connect the cylinder chamber to a hydraulic accumulator by way of a multiway valve. As soon as the tension rod head or heads is or are supported on the ram, this leads to an increase in the pressure in the cylinder chamber, which is filled with a hydraulic pressure medium and provides a static hydraulic cushion. This is isolated by the multiway valve in the form of a 2/2-way valve. Only when or for releasing the locking of the ram is the multiway valve opened electrically or hydraulically so that the pressure prevailing in the cylinder chamber can be relieved via a pipeline into the hydraulic accumulator. If the line connecting the cylinder chamber with the accumulator passes axially through a threaded spindle having the tension rod at its free end the result is a closed system for transfer of pressure medium protected from the exterior.

If a pressure-operated switch is connected to the cylinder chamber the movement of the tension rod against the bracket or bearing surface on the ram can be pressure-actuated. The upward movement of the tension rod need only be interrupted once there is a force connection between the ram and the tension rod; this is indicated by the pressure switch. Alternatively, the upward movement of the tension rod relative to the ram can be interrupted, and the locking thus ended, by means of travel-dependent limit switches. In contrast to this the travel-dependent limit switches used to release known ram locking devices have to be installed so that interruption already occurs immediately before the bearing surface of the tension rod head comes into contact with the bearing surface of the ram.

The cylinder can also extend in the head of the tension rod transverse to the axis thereof, and can house pistons moving in opposite directions and acting by way of a toggle mechanism on respective thrust elements parallel to the axis and projecting from the tension rod head.

The hydraulic accumulator and the multiway valve can be arranged directly in the head of the tension rod, with the accumulator preferably consisting of a cylinder in which pressure-tight spring-loaded pistons are guided.

In this embodiment of the invention all the components of the closed hydraulic system are accommodated within the head of the tension rod, since the mechanical advantage provided by the toggle mechanisms makes a very compact construction possible.

BRIEF DESCRIPTION OF THE DRAWINGS

The invention will now be described in more detail, by way of example, with reference to embodiments illustrated in the accompanying drawings, in which.

DETAILED DESCRIPTION OF PREFERRED EMBODIMENTS OF THE INVENTION

Figure 1:
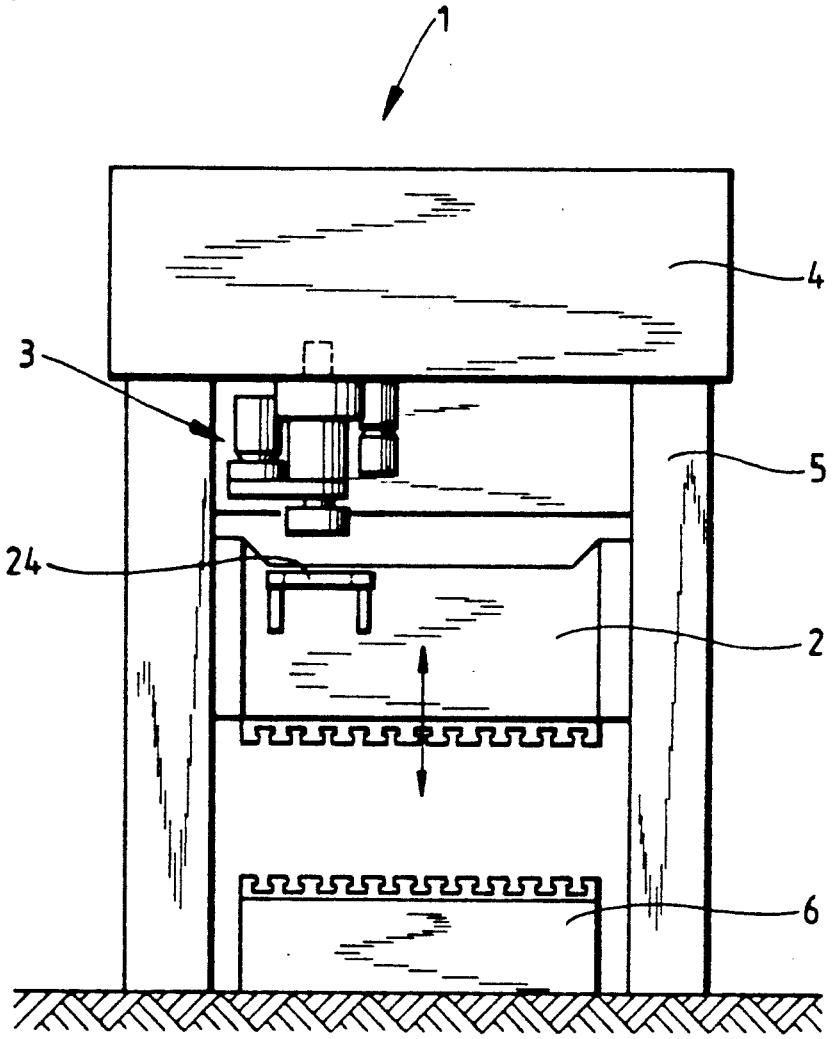
FIG. 1 is a diagrammatic front view of a press with a locking device in accordance with the invention.

In a heavy press 1 shown in FIG. 1, two or preferably even four ram locking devices 3, depending on the weight of the ram 2, are suspended from the crown 4 of the press frame 5. The ram 2 is moved up and down in the press frame 5 (as shown by the double arrow in FIG. 1) relative to the bed 6 by means of a ram drive (not shown). The ram locking device 3 is bolted on to the crown 4 of the press 1 by way of a flange 7 (see FIG. 2). A threaded spindle 9 that can both be rotated and moved up and down is mounted in a cylindrical housing 8 of the ram locking device 3. With either electrically or hydraulically driven ram locking devices hydraulic and/or electrical energy is only needed for moving the spindle out and in and for pivoting it; in the locking position the system is mechanically self-locking. The ram locking device 3 is provided with a lifting motor 12 to move the spindle 9 upwards and downwards and with a torque motor 11 to rotate it.

Figure 2:
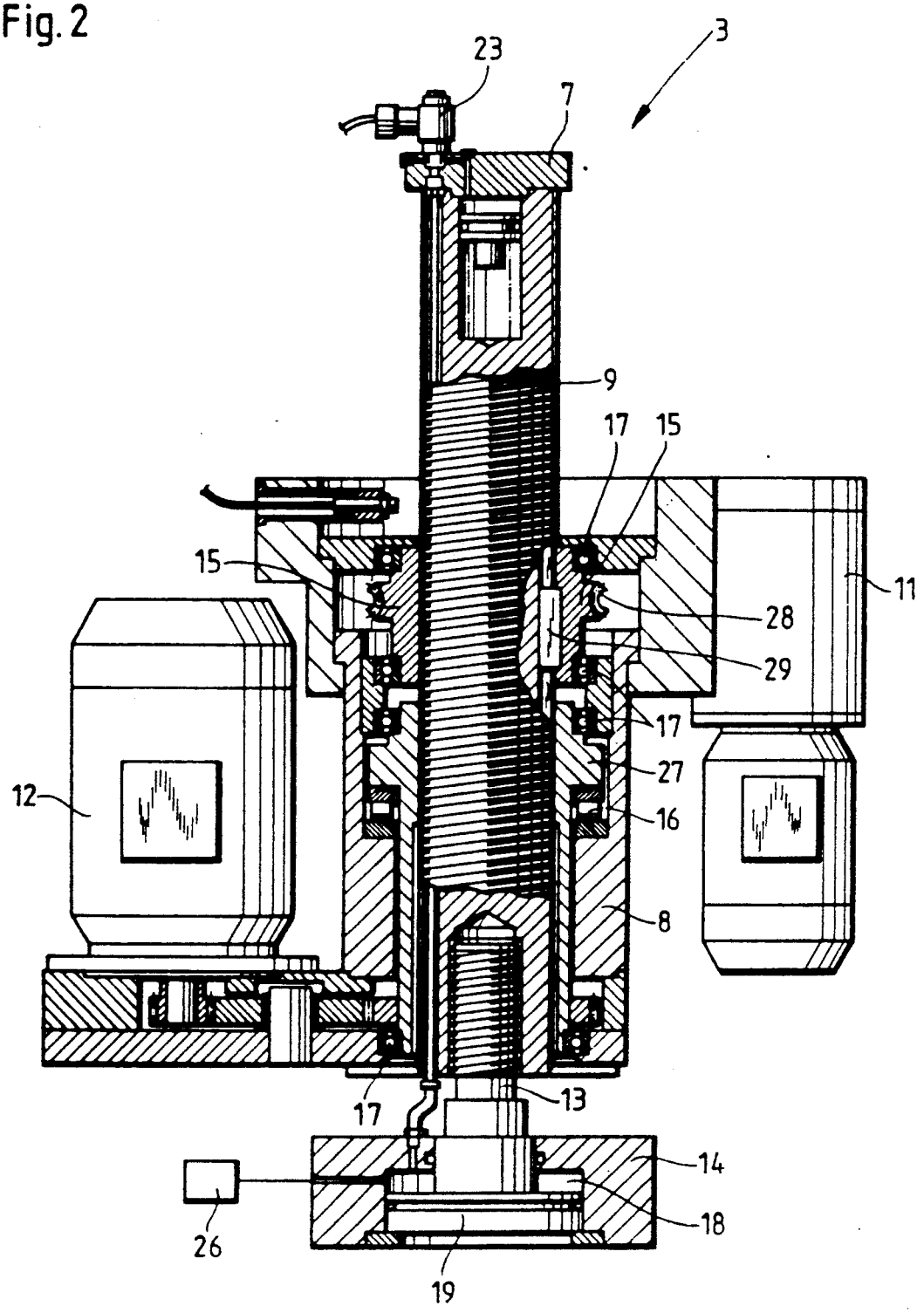
FIG. 2 is a longitudinal section through a locking device in accordance with the invention.

The spindle 9 emerges from the housing 8 at the ram end, as shown in FIG. 2, and is provided at this end with a tension rod 13 having a hammer-shaped head 14. The spindle 9 is guided in an adjusting nut 27 in the interior of the housing 8, driven by the lifting motor 12; to take up the high forces arising in supporting the ram 2 this nut is mounted both in an axial bearing 16 and in radial bearings 17. The axial bearing 16 transmits the weight of the ram 2 to the housing 8, while the radial bearings 17 enable the adjusting nut 27 to rotate easily. Since the adjusting nut 27 is fixed axially in the housing 8, rotation of the adjusting nut 27 is converted into translation of the threaded spindle 9, which can thus be moved in and out together with the tension rod 11.

The threaded spindle 9 is also connected to a bushing 15 via a sliding key 29 so that it can be displaced axially but not rotated. The bushing 15 is likewise mounted in the housing 8 by means of rolling bearings 17 and coupled to the torque motor via a worm gear 28. This torque drive is self-locking or is provided with a braking motor, so that when the bushing 15 is stationary no rotation of the threaded spindle 9 is possible.

The head 14 of the tension rod is in the form of a single-acting hydraulic cylinder and receives a piston 19 of the tension rod 13 in a cylinder 18. The tension rod head 14 serving as the cylinder is secured against rotation relative to the piston. The cylinder 18, filled with a hydraulic pressure medium, is connected to a hydraulic accumulator 22 by a pipeline 21 running axially through the threaded spindle 9, as shown in the hydraulic plan in FIG. 3. The cylinder 18 can be isolated by a 2/2-way valve 23 integrated in the pipeline 21.

To lock the ram 2 of the press 1 the threaded spindle 9, and thus also the tension rod 13 with the head 14 fixed thereto, is first of all lowered by rotating the adjusting nut 27 until the tension rod head 14 has entered a corresponding opening 24 (see FIG. 1) in the ram 2. After the tension rod heads 14 of all the ram locking devices 3 have entered the corresponding openings 24 of the ram they are swivelled through 90° by rotation of the spindle 9 by the torque motor 11 into the holding position in which the tension rod heads 14 and the openings 24 overlap, i.e. cross. The threaded spindles 9 are then again raised until the tension rod heads 14 are seated on the bearing surfaces of the openings 24 in the ram 2. As soon as the full holding force of the ram locking devices 3 is acting on the tension rod heads 14, this leads to an increase in pressure in the respective cylinder chambers 18 defined by the pistons 19 and the tension rod heads 14. Since the 2/2-way valve 23 is closed, a static hydraulic cushion for the tension rod heads 14 is thus formed through the cylinder 18.

Figure 3:
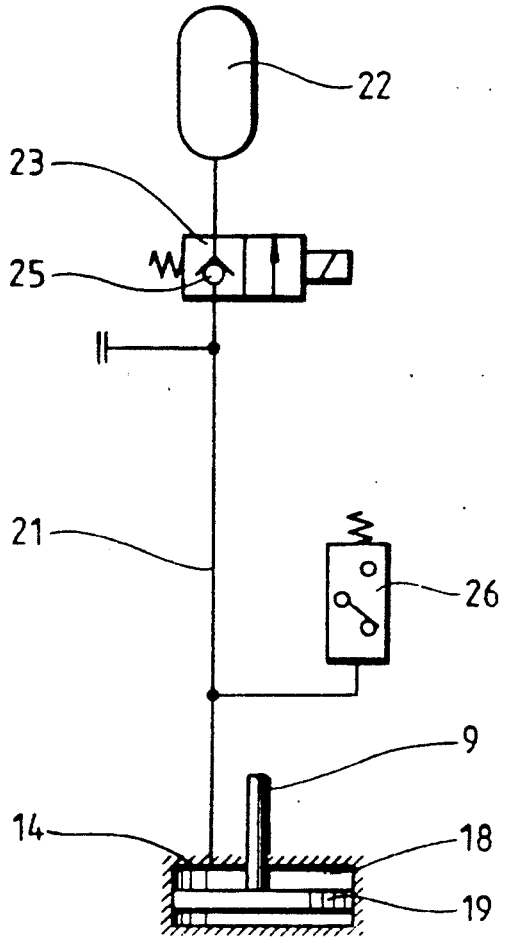
FIG. 3 is a hydraulic circuit diagram for the supply of pressure medium to a cylinder formed in the head of the tension rod of the ram locking device shown in FIG. 2.

To release the locking devices 3 the directional control valve 23 is opened electrically or hydraulically and the pressure prevailing in the cylinder 18 is immediately relieved via the pipeline 21 into the hydraulic accumulator 22 (see FIG. 3). The ram 2 resting on the tension rod heads 14 can then still sink by an amount less than the stroke of the tension rod cylinder, but with the pressure relief in the cylinder 18 in any event unloading the spindle 9 and the adjusting nut 15 so that as a result of the smaller frictional forces the locking device can be easily and reliably released. When the release is complete the valve 23 is closed again; the hydraulic pressure medium is thereupon returned from the slightly preloaded hydraulic accumulator 22 through a non-return valve 25 of the directional control valve 23 into the now pressure-free cylinder chamber 18 of the tension rod head 14. In this position the ram locking device is ready for a new locking procedure.

The adjusting action of the ram-locking device 3 can be monitored either by mechanical limit switches or by proximity position switches, which offer a high level of reliability. To limit the adjusting travel of the threaded spindle 9 operating cams can be used which, when fitted at appropriate places, actuate the switches in the upper and lower end positions of the spindle 9. The signal to interrupt the upward movement of the tension rod 13 after its movement into the corresponding opening 24 in the ram 2 can advantageously be initiated by a pressure switch 26 (see FIG. 2) connected to the cylinder chamber 18, i.e. in a pressure-dependent manner. To indicate the locking or unlocking position in the bracket of the ram 2 respective end switches may be actuated by an operating cam in the end positions of the 90° rotary movement of the tension rod head 14.

Figure 4:
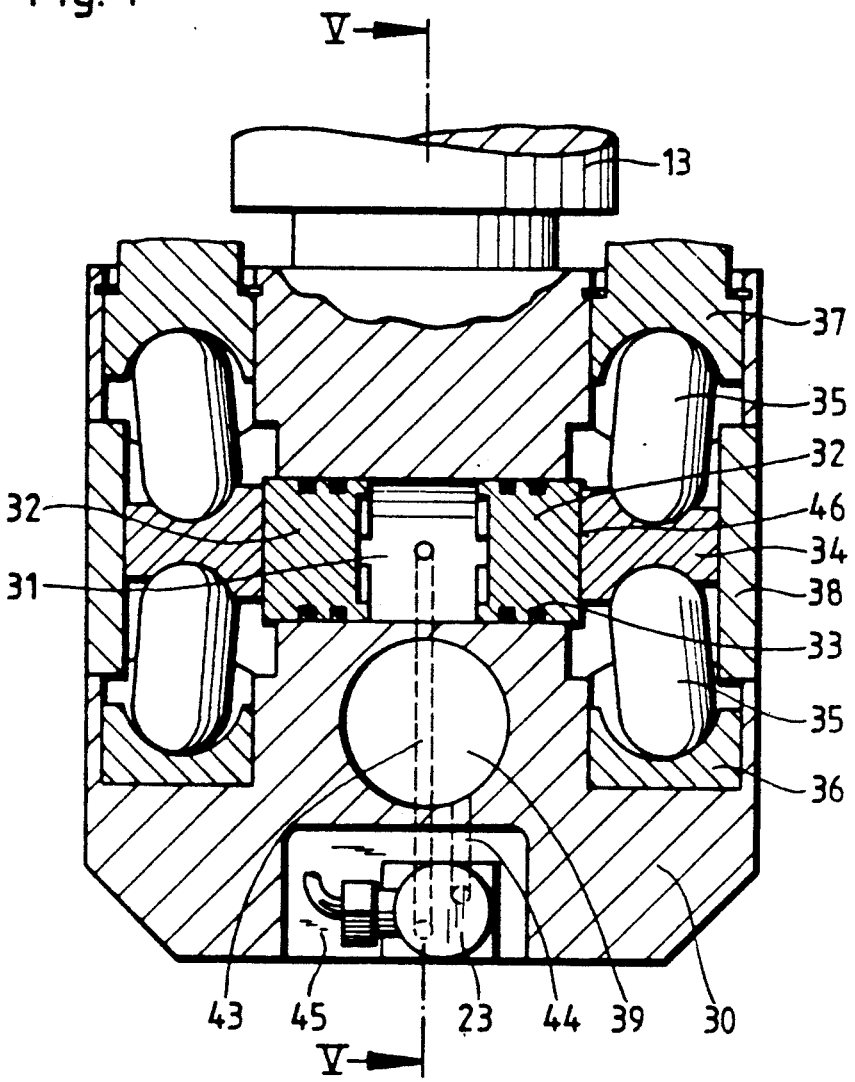
FIG. 4 is a longitudinal section through another embodiment of a ram locking device in accordance with the invention.
Figure 5:
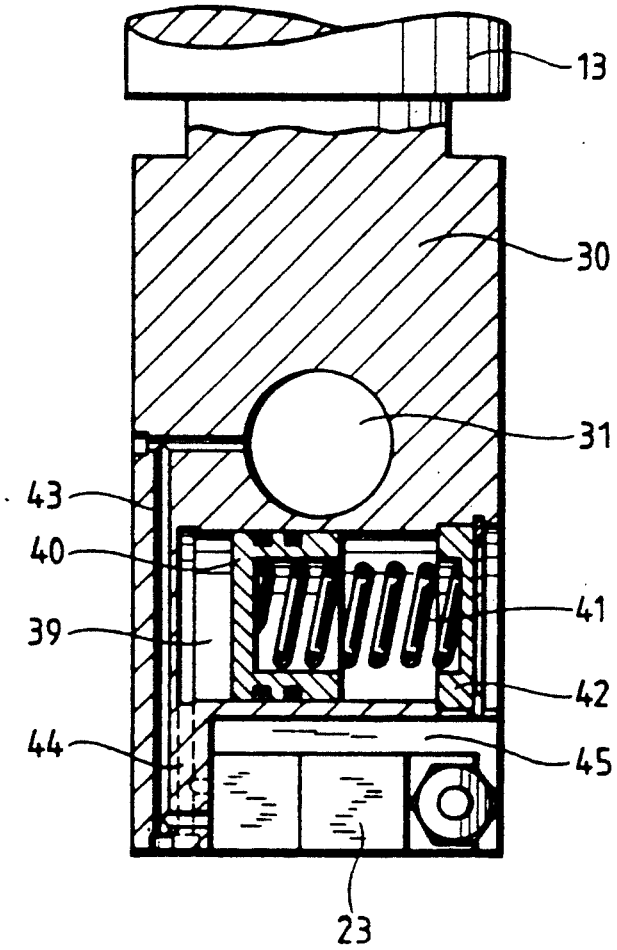
FIG. 5 is a section along the line V—V in FIG. 4.

In the embodiment shown in FIGS. 4 and 5 a cylinder chamber 31 extends in the tension rod head 30 transversely to the axis of the tension rod head. In the cylinder chamber 31 a pair of opposed pistons 32 are guided and sealed by seals 33. These pistons 32 have their ends 46 in contact with thrust members 34 whose travel transverse to the axis of the tension rod head is limited by stop plates 38. A pair of toggles 35 are supported with their inner ends on a respective thrust member 34 and with their other ends on the one side on a fixed abutment 36 and on the other side on pressure bolts 37 movable parallel to the axis of the tension rod head. In the position shown the heads of these pressure bolts 37 project above the top of the tension rod head 30. By means of these pressure bolts 37 the tension rod head 30 can be brought to bear on the bearing surfaces of the openings 24 in the ram in the manner described with reference to FIGS. 1 to 3, whereby the ram 2 is locked.

As described in the embodiment shown in FIGS. 1 to 3, to lock the ram 2 the multiway valve 23, which is connected on the one hand by way of a channel bore 43 to the cylinder chamber 31 and by way of a channel bore 44 to a cylinder chamber 39 of a pressure accumulator, is closed. When the multiway valve 23 is closed a hydrostatic pressure cushion therefore builds up in the cylinder chamber 31 that prevents any movement of the piston 32 and thus of the toggle mechanism 34, 35 and of the pressure bolts 37.

A pressure-tight piston 49 acted on by a compression spring 41 is guided in the cylinder chamber 39. The compression spring 41 is supported on a cylinder cover 42, so that through the spring 41 a pressure is built up in the cylinder chamber 39 which, while not sufficient to hold the piston 32 and the toggle mechanism 34, 35 in the locked position shown when the full weight of the ram acts on the pressure bolts 37 and the multiway valve 23 is open, is nevertheless enough to move the piston 32 and the toggle mechanism 34, 35 and the pressure bolts 37 back into the position shown in FIG. 4 after the ram locking device is released by opening the multiway valve 23 and the tension rod head 30 has been moved away from the openings 24 in the ram 2 by actuation of the lifting motor 12.

The action of the ram locking device shown in FIGS. 4 and 5 is thus the same as that of the ram locking device of FIGS. 1 to 3 except that to effect unlocking the tension rod head 14 is not lowered as in the embodiment shown in FIGS. 1 to 3, but only the pressure bolts 37 are lowered and the pistons 32 with the thrust members 34 move radially inwards, while the toggles 35 assume a more greatly inclined angular position.

The multiway valve 23 is arranged in a recess 45 in the tension rod head 30, so that all the components of the closed hydraulic system are accommodated within the tension rod head 30. Specifically, this is made possible by the fact that a very compact design can be used for the toggle mechanism 34, 35 and its actuating piston 32 because of the mechanical advantage provided by the toggle mechanism.

What is claimed is:

1. A device for locking a tool-carrying ram of a chipless press, said locking device comprising:

a tensioned rod having a head for supporting the tool-carrying ram;

means for axially displacing said tension rod;

means for providing a cushion for said tension rod in a locked position thereof; and means for relieving the cushion to thereby provide for release of a locking engagement of said head with the tool-carrying ram.

2. The locking device of claim 1, wherein said cushion providing means includes a cylinder chamber formed in said head.

3. The locking device of claim 2, wherein said head is formed as a cylinder, said tension rod further comprising a piston received in said cylinder chamber.

4. The locking device of claim 3, further comprising means for supporting said tension rod and thereby said head against rotation.

5. The locking device of claim 2, wherein said cushion relieving means comprises:

an accumulator; and a multiway valve for connecting said cylinder chamber with said accumulator.

6. The locking device of claim 5, wherein said displacing means includes a threaded spindle carrying said tension rod at a free end thereof, said locking device further comprising a line for connecting said cylinder chamber with said accumulator and extending axially through said threaded spindle.

7. The locking device of claim 5, wherein said accumulator and said multiway valve are arranged in said head.

8. The locking device of claim 7, wherein said accumulator comprises:

a chamber;

a piston displaceable in said chamber; and spring means for biasing said piston into a position in which hydraulic medium flows from said accumulator back into said cylinder chamber.

9. The locking device of claim 2, further comprising a pressure-operated switch, connected with said cylinder chamber for controlling movement of said tension rod in accordance with the pressure in said cylinder chamber.

10. The locking device of claim 2, wherein said cylinder chamber extends transversely to an axis of said head, said locking device, further comprising:

two opposed pistons displaceable in said cylinder chamber;

two thrust elements connected with said opposed pistons, respectively;

two pressure elements for locking the tool-carrying ram; and two toggle mechanisms for connecting said two thrust elements with said two pressure elements, respectively.

* * * * *